US011020759B2

(12) United States Patent
Bierie

(10) Patent No.: US 11,020,759 B2
(45) Date of Patent: Jun. 1, 2021

(54) SYSTEM FOR CONTROLLING AIR SHAPING FLOW IN SPRAY CAP OF SPRAY TOOL

(71) Applicant: Carlisle Fluid Technologies, Inc., Scottsdale, AZ (US)

(72) Inventor: William K. Bierie, Scottsdale, AZ (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 159 days.

(21) Appl. No.: 15/470,550

(22) Filed: Mar. 27, 2017

(65) Prior Publication Data

US 2017/0304852 A1 Oct. 26, 2017

Related U.S. Application Data

(60) Provisional application No. 62/325,061, filed on Apr. 20, 2016.

(51) Int. Cl.

| | |
|---|---|
| ***B05B 7/12*** | (2006.01) |
| ***B05B 7/06*** | (2006.01) |
| ***B05B 7/08*** | (2006.01) |
| ***B05B 7/02*** | (2006.01) |
| *B05B 7/24* | (2006.01) |
| *B05B 7/14* | (2006.01) |

(52) U.S. Cl.

CPC ..... *B05B 7/12* (2013.01); *B05B 7/025* (2013.01); *B05B 7/068* (2013.01); *B05B 7/0815* (2013.01); *B05B 7/02* (2013.01); *B05B 7/1209* (2013.01); *B05B 7/14* (2013.01); *B05B 7/2424* (2013.01)

(58) Field of Classification Search

CPC ..... B05B 7/068; B05B 7/066; B05B 7/0815; B05B 7/062; B05B 7/02; B05B 7/2424; B05B 7/14; B05B 7/1209; B05B 7/025; B05B 7/12

USPC ..... 239/291, 296, 30

See application file for complete search history.

(56) References Cited

U.S. PATENT DOCUMENTS

| | | | | |
|---|---|---|---|---|
| 2,235,708 A * | 3/1941 | Jenkins | B05B 7/0815 239/296 |
| 5,178,330 A * | 1/1993 | Rodgers | B05B 5/03 239/300 |
| 5,209,405 A * | 5/1993 | Robinson | B05B 7/0081 239/290 |
| 5,322,221 A | 6/1994 | Anderson | |

(Continued)

FOREIGN PATENT DOCUMENTS

| | | |
|---|---|---|
| CN | 1976758 A | 6/2007 |
| CN | 101479047 A | 7/2009 |

(Continued)

OTHER PUBLICATIONS

PCT International Search Report & Written Opinion for PCT Application No. PCT/US2017/028197 dated Aug. 11, 2017, 12 pgs.

(Continued)

*Primary Examiner* — Jason J Boeckmann

(74) *Attorney, Agent, or Firm* — Peter J Beardsley

(57) ABSTRACT

A system, including a spray cap configured to couple to a spray tool, wherein the spray cap includes a body and an air shaping passage through the body. The air shaping passage includes a flow control passage, an expansion chamber downstream from the flow control passage, and one or more air shaping outlets downstream from the expansion chamber.

19 Claims, 8 Drawing Sheets

(56) References Cited

U.S. PATENT DOCUMENTS

| | | | | |
|---|---|---|---|---|
| 5,613,637 | A | 3/1997 | Schmon | |
| 6,089,471 | A | 7/2000 | Scholl | |
| 6,158,672 | A | 12/2000 | Millan | |
| 6,230,986 | B1 * | 5/2001 | Vacher | B05B 7/0815 239/297 |
| 6,471,144 | B1 * | 10/2002 | Huang | B05B 7/0815 239/290 |
| 7,163,160 | B2 * | 1/2007 | Liu | B05B 7/066 239/290 |
| RE40,433 | E | 7/2008 | Schmon | |
| 7,896,265 | B2 * | 3/2011 | Takahashi | B05B 5/0407 239/224 |
| 2009/0121048 | A1 * | 5/2009 | Noshima | B05B 7/02 239/291 |
| 2012/0234942 | A1 | 9/2012 | Unosawa et al. | |

FOREIGN PATENT DOCUMENTS

| | | | |
|---|---|---|---|
| CN | 201815424 | U | 5/2011 |
| CN | 103517765 | A | 1/2014 |
| CN | 104741262 | A | 7/2015 |
| DE | 2737680 | A1 | 3/1978 |
| EP | 0114064 | A2 | 7/1984 |
| GB | 2215239 | A | 9/1989 |
| JP | H02111465 | A | 4/1990 |
| JP | H05104037 | A | 4/1993 |
| JP | 2007021449 | A | 2/2007 |
| JP | 2009072703 | A | 4/2009 |
| WO | 8101670 | A1 | 6/1981 |

OTHER PUBLICATIONS

Japanese Office Action for JP Application No. 2018-555239 dated Dec. 3, 2019, 3 pgs.

Japanese Office Action for JP Application No. 2018-555239 dated Jul. 28, 2020, 2 pgs.

Chinese Office Action for CN Application No. 201780024189.X dated Sep. 15, 2020, 10 pgs.

* cited by examiner

SYSTEM FOR CONTROLLING AIR SHAPING FLOW IN SPRAY CAP OF SPRAY TOOL

CROSS REFERENCE TO RELATED APPLICATION

This application claims priority to and benefit of U.S. Provisional Patent Application No. 62/325,061, entitled "SYSTEM FOR CONTROLLING AIR SHAPING FLOW IN SPRAY CAP OF SPRAY TOOL," filed Apr. 20, 2016, which is herein incorporated by reference in its entirety.

BACKGROUND

The invention relates generally to spray devices, and, more particularly, to spray caps for spray tools.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Spray coating devices are used to apply a spray coating to a wide variety of target objects. In order to achieve a desired finish quality of the spray coating, the spray coating devices may output a spray of coating material with a particular shape. Unfortunately, the shape may be non-uniform or less than optimal due to various factors, such as a non-uniform flow or distribution of air through the spray coating device.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In certain embodiments, a system includes a spray cap configured to couple to a spray tool, wherein the spray cap includes a body and an air shaping passage through the body. The air shaping passage includes a flow control passage, an expansion chamber downstream from the flow control passage, and one or more air shaping outlets downstream from the expansion chamber.

In certain embodiments, a system includes a spray tool including a body portion having a fluid passage and an air passage and a head portion fluidly coupled to the fluid passage and the air passage. The head portion includes a spray cap having a fluid nozzle receptacle, an air atomization passage, and an air shaping passage. The air shaping passage includes a flow control passage, an expansion chamber downstream from the flow control passage, and one or more air shaping outlets downstream from the expansion chamber. The head portion also includes a fluid nozzle disposed in the fluid nozzle receptacle.

In certain embodiments, a system includes a flow control insert configured to mount within a recess in a body of a spray cap of a spray tool. The flow control insert includes an air shaping passage having a flow control passage, an expansion chamber downstream from the flow control passage, and one or more air shaping outlets downstream from the expansion chamber.

DRAWINGS

These and other features, aspects, and advantages of the present invention will become better understood when the following detailed description is read with reference to the accompanying drawings in which like characters represent like parts throughout the drawings, wherein.

Figure 2:
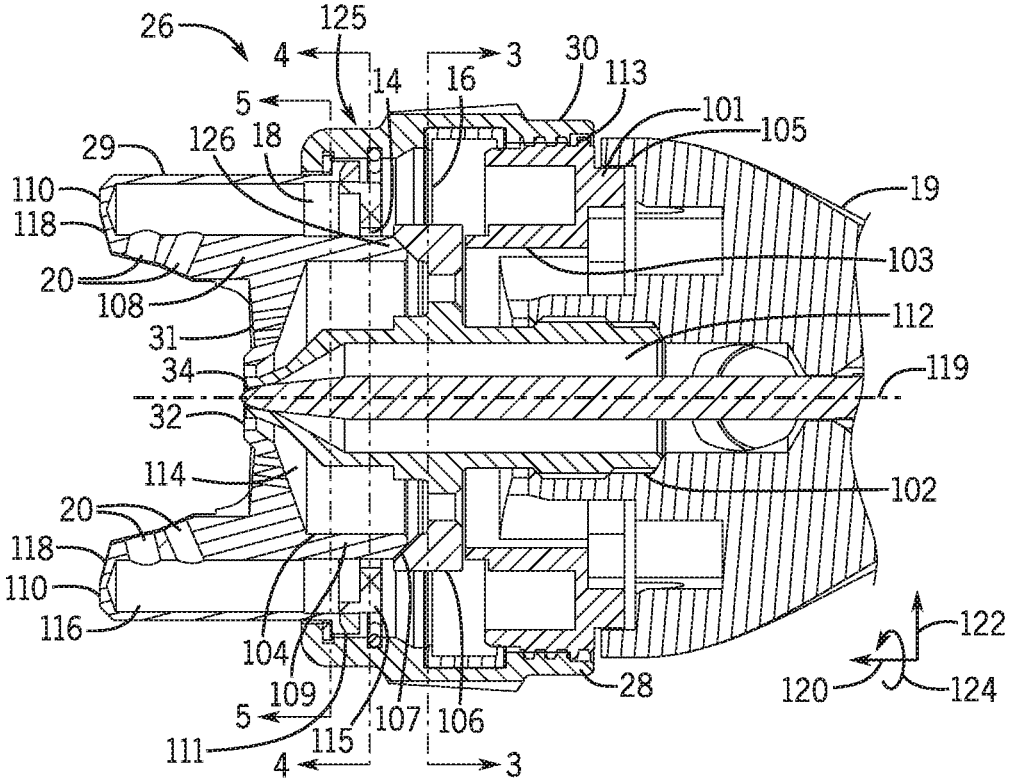
FIG. 2 is a partial cross-sectional side view of an embodiment of the spray tool of FIG. 1 taken within line 2-2, illustrating details of an air shaping passage having a flow control passage, an expansion chamber downstream from the flow control passage, and one or more air shaping outlets downstream from the expansion chamber.
Figure 15:
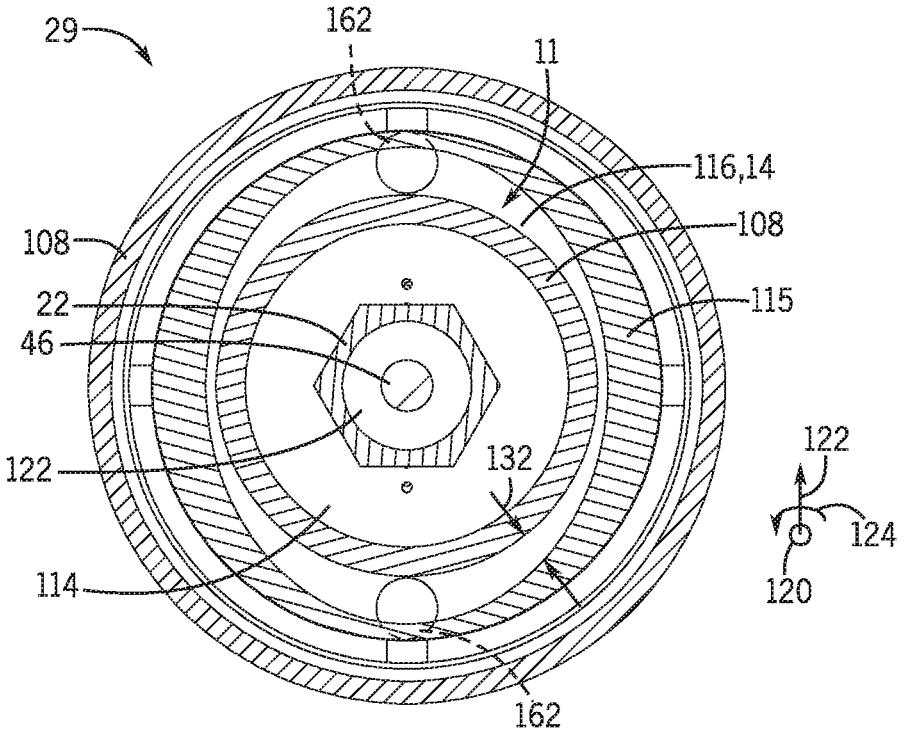
Figure 16:
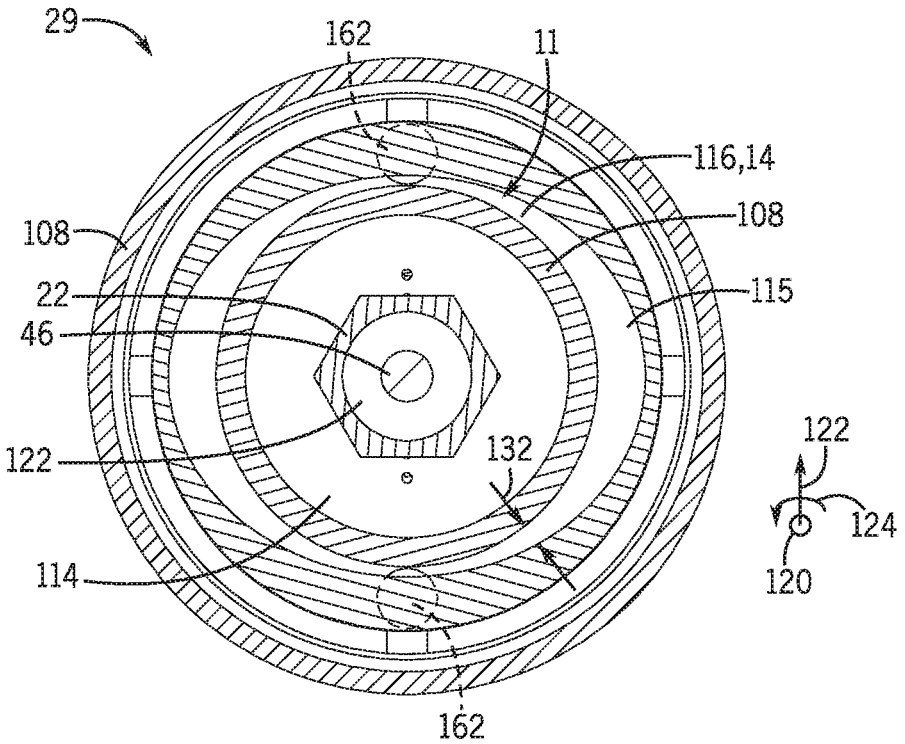

FIG. 15 is a cross-sectional front view of an embodiment of the spray cap of FIG. 2 taken along line 4-4, illustrating another embodiment of a portion of the air shaping passage at the flow control passage, wherein the flow control passage has a radial width that varies in a circumferential direction about the central axis of the spray cap, such that the radial width increases toward air shaping horns of the spray cap; and FIG. 16 is a cross-sectional front view of an embodiment of the spray cap of FIG. 2 taken along line 4-4, illustrating another embodiment of a portion of the air shaping passage at the flow control passage, wherein the flow control passage has a radial width that varies in a circumferential direction about the central axis of the spray cap, such that the radial width decreases toward air shaping horns of the spray cap.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to a spray tool, and, more particularly, to a spray cap or an air cap for spray atomization. The spray cap has a body and an air shaping passage to supply air to horns of the spray tool, wherein the air shaping passage may include a flow control passage or an annular gap, an expansion chamber downstream from the flow control passage, and one or more air shaping outlets downstream from the expansion chamber. In certain embodiments, the flow control passage, the expansion chamber, and the air shaping outlets may be integrally formed as part of the spray cap (e.g., a one-piece structure). In some embodiments, the flow control passage may be formed at least partially or entirely through a flow control insert, which fits within a recess in a body of the spray cap. The flow control passage and expansion chamber helps to regulate and distribute an air shaping flow more uniformly around the spray cap, thereby improving the shape of a spray of coating material and the quality of a coating by the spray. For example, the flow control passage may be a substantially annular passage (e.g., a continuous annular passage or a segmented annular passage), which restricts the air shaping passage before expansion in the expansion chamber. In this manner, the flow control passage and expansion chamber help to remove variations in the pressure, velocity, and flow rate of the air shaping flow caused by various upstream features (e.g., one or more discrete air supply passages upstream of the spray cap). The flow control passage, due to the substantially annular shape and flow restriction, thus helps to more uniformly distribute the air shaping flow to the air shaping outlets. As a result, the more uniform air shaping flow through the air shaping outlets helps to improve the shape of the spray and the quality of the coating applied by the spray. In addition, the flow control passage and expansion chamber may help to reduce noises created by the air shaping flow through the spray tool.

Figure 1:
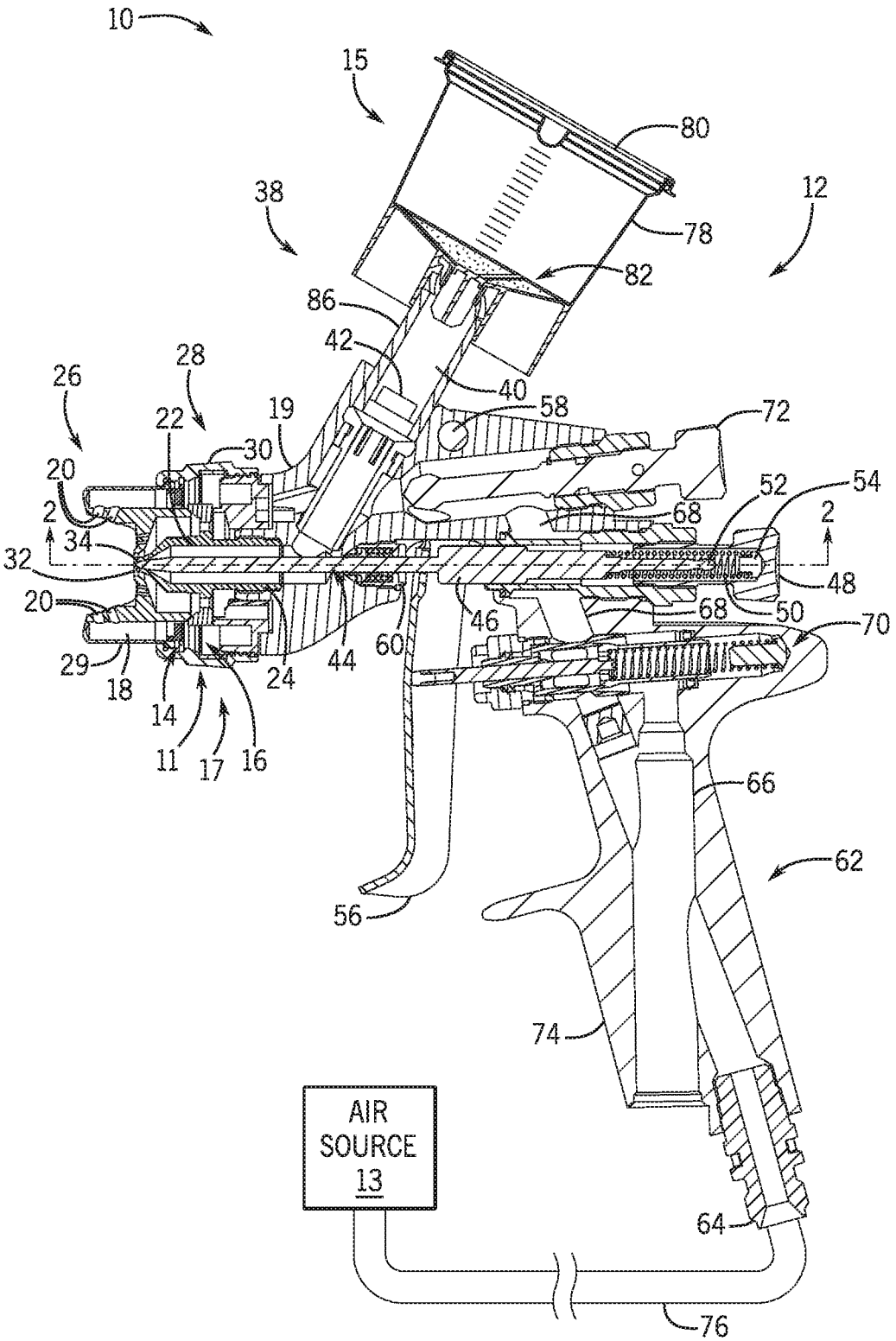
FIG. 1 is a cross-sectional side view of an embodiment of a spray tool having a spray cap with flow control features along an air shaping passage.

FIG. 1 is a cross-sectional side view illustrating an embodiment of the spray tool assembly 10 (e.g., spray coating gun) having a flow control section 11 in a spray tool 12, wherein the flow control section 11 has a flow control passage 14 between an upstream chamber 16 (e.g., air shaping supply chamber) and a downstream chamber 18 (e.g., expansion chamber) leading to one or more air shaping outlets 20. As discussed in further detail below, the flow control section 11 is configured to regulate and distribute an air shaping flow more uniformly to improve the shape of a spray of coating material and quality of a coating by the spray.

The spray tool assembly 10 includes an air supply 13 and a gravity fed container assembly 15 coupled to the spray tool 12. As illustrated, the spray tool 12 includes a spray tip assembly 17 coupled to a body 19. The spray tip assembly 17 includes a fluid nozzle or a liquid delivery tip assembly 22, which may be removably inserted into a receptacle 24 of the body 19. For example, a plurality of different types of spray tool devices may be configured to receive and use the fluid nozzle 22. The spray tip assembly 17 also includes a spray formation assembly 26 coupled to the fluid nozzle 22. The spray formation assembly 26 may include a variety of spray formation mechanisms, such as air, rotary, and electrostatic atomization mechanisms. However, the illustrated spray formation assembly 26 comprises a head portion 28 that is fluidly couple to fluid/liquid passage and air passage. The head portion 28 is removably secured to the body 19 via a retaining assembly 30 (e.g., threads, bolts and nuts, retaining ring, etc.). The head portion 28 includes a spray cap 29, which includes a variety of air atomization orifices, such as one or more central air orifices or atomization outlets 32 disposed about a fluid tip exit or outlet 34 (e.g., liquid outlet) from the fluid nozzle 22 along a central portion of the spray cap 29. The spray cap 29 may also have one or more air shaping outlets or orifices 20, which use air jets to force the spray to form a desired spray pattern (e.g., a flat spray). The spray formation assembly 26 may also include a variety of other atomization mechanisms to provide a desired spray pattern and droplet distribution.

The body 19 of the spray tool 12 includes a variety of controls and supply mechanisms for the spray tip assembly 17. As illustrated, the body 19 includes a liquid delivery assembly 38 having a liquid passage 40 extending from a liquid inlet coupling 42 to the fluid nozzle 22. The body 19 also includes a liquid valve assembly 44 having a needle valve 46 extending movably through the body 19 between the fluid nozzle 22 and a liquid valve adjuster 48. The liquid valve adjuster 48 is rotatably adjustable against a spring 50 disposed between a rear section 52 of the needle valve 46 and an internal portion 54 of the liquid valve adjuster 48. The needle valve 46 is also coupled to a trigger 56, such that the needle valve 46 may be moved inwardly away from the fluid nozzle 22 as the trigger 56 is rotated counter clockwise about a pivot joint 58. However, any suitable inwardly or outwardly openable valve assembly may be used within the scope of the present technique. The liquid valve assembly 44 also may include a variety of packing and seal assemblies, such as packing assembly 60, disposed between the needle valve 46 and the body 19.

An air supply assembly 62 is also disposed in the body 19 to facilitate air-driven atomization and shaping at the spray formation assembly 26. The illustrated air supply assembly 62 extends from an air inlet coupling 64 to the spray cap 29 via air passages 66 and 68. The air supply assembly 62 also includes a variety of seal assemblies, air valve assemblies, and air valve adjusters to maintain and regulate the air pressure and flow through the spray tool 12. For example, the illustrated air supply assembly 62 includes an air valve assembly 70 coupled to the trigger 56, such that rotation of the trigger 56 about the pivot joint 58 opens the air valve assembly 70 to allow air flow from the air passage 66 to the air passage 68. The air supply assembly 62 also includes an air valve adjustor 72 to regulate the air flow to the spray cap 29. As illustrated, the trigger 56 is coupled to both the liquid valve assembly 44 and the air valve assembly 70, such that liquid and air simultaneously flow to the spray tip assembly 17 as the trigger 56 is pulled toward a handle 74 of the body 19. Once engaged, the spray tool 12 produces an atomized spray with a desired spray pattern and droplet distribution.

The gravity fed container assembly 15 and the air supply 13 provide a respective coating material (e.g., liquid or powder coating material) and air to the spray tool 12. The air supply 13 enables the spray tool 12 to spray and shape the coating material exiting the gravity fed container assembly 15. The air supply 13 couples to the spray tool 12 at the air inlet coupling 64 and supplies air via an air conduit 76. Embodiments of the air supply 13 may include an air compressor, a compressed air tank, a compressed inert gas tank (e.g., nitrogen tank), or a combination thereof. In the illustrated embodiment, the gravity fed container assembly 15 is directly mounted to the spray tool 12 to supply a coating material (e.g., a solvent, paint, sealer, stain, etc.) to the spray tool 12. The illustrated gravity fed container assembly 15 includes a spray coating supply container 78, a lid 80, a filter assembly 82, and an adapter 86.

FIG. 2 is a partial cross-sectional side view of an embodiment of the spray tool of FIG. 1, illustrating details of the spray formation assembly 26 of the spray cap 29. As illustrated, the spray formation assembly 26 includes the head portion 26 with a mounting insert 101, the fluid nozzle 22, the spray cap 29, and a retaining assembly 30. The fluid nozzle 22 extends into a recess 102 (e.g., annular recess) in the body 19, through a central bore 103 in the mounting insert 101, through a central bore 104 in the spray cap 29, and partially into the fluid outlet 34 in the spray cap 29. The fluid nozzle 22 may be hand-inserted, press-fit, threadingly coupled, or otherwise fixedly or removably coupled into the recess 102 of the body 19. Likewise, the mounting insert 101 extends circumferentially 124 around the fluid nozzle 22, and may be removably or fixedly coupled to a recess 105 (e.g., annular recess) in the body 19. For example, the mounting insert 101 may be press-fit or threadingly coupled to the recess 105 in the body 19. The fluid nozzle 22 also includes an outer flange portion 106 (e.g., a tapered annular flange portion), which fits between the mounting insert 101 and the spray cap 29. For example, the outer flange portion 106 may abut a tapered portion 107 (e.g., tapered annular surface) on a body 108 of the spray cap 29. In the illustrated embodiment, the tapered portion 107 is disposed on an inner wall 109 (e.g., inner annular wall) of the body 108. Thus, the outer flange portion 106 and the tapered portion 107 create a tapered interface (e.g., a compression fit interface) between the spray cap 29 and the fluid nozzle 22 upon complete assembly of the mounting insert 101, the fluid nozzle 22, the spray cap 29, and the retaining assembly 30. For example, the retaining assembly 30 may include a retainer nut 125, which couples with an outer wall 111 (e.g., radially protruding outer annular flange) of the body 108 of the spray cap 29 and, also, couples with the mounting insert 101 (e.g., via a threaded interface 113). As the retainer nut 125 threads onto the mounting insert 101 via the threaded interface 113, the retainer nut 125 pulls the spray cap 29 inwardly toward the body 19, and axially 120 compresses the fluid nozzle 22 between the spray cap 29 and the mounting insert 101.

In the illustrated embodiment, a coating material passage 112 (e.g., a fluid or liquid passage), an air atomization passage 114, and one or more air shaping passages 116 extend through the body 19 of the spray tool 12, the mounting insert 101, and a body 108 of the spray cap 29. During a spraying operation, the coating material (e.g., liquid or powder coating material such as paint) exits the spray tool 12 at the fluid outlet 34 when the needle valve 46 (see FIG. 1) is actuated to retract away from the fluid outlet 34. Simultaneously, air through the air atomization passage 114 is ejected from the air atomization outlets 32 to atomize the liquid coating material. Substantially simultaneously, air through the air shaping passage 116 is ejected from the air shaping outlets 20 to shape or force the spray (e.g., the atomized liquid coating material) to form a desired spray pattern (e.g., a flat spray).

The spray cap 29 may be described with reference to a central longitudinal axis 119, an axial direction or axis 120, a radial direction or axis 122, and a circumferential direction or axis 124. As illustrated, the spray cap 29 is configured to output the atomization air and liquid coating material in the axial direction 120, and the air atomization passage 114 and the air shaping passage 116 are substantially annular passages extending circumferentially about the central axis 119. In particular, the air atomization passage 114 and the air shaping passage 116 are concentrically disposed about the fluid passage 112 one after another in the radial direction 122. The spray cap 29 includes a plurality of horns or axial protrusions 110 (e.g., 2, 3, 4, 5, 6, or more protrusions) extending downstream in the axial direction 120 away from a central region 31 having the outlets 32 and 34, such that the air shaping passages 116 extend downstream beyond the outlets 32 and 34 to downstream portions 118 (e.g., tip portions) of the protrusions 110 at one or more downstream positions having the air shaping outlets 20. Accordingly, the spray tool 12 outputs the atomization air and the coating material (e.g., liquid coating material) through the outlets 32 and 34 at the central region 31 to form a spray of the coating material upstream of the air shaping outlets 20, such that the air shaping outlets 20 then direct air shaping flows (e.g., jets) from downstream portions 118 of the protrusions 110 inwardly toward the spray and the axis 119 to shape the spray into a desired spray pattern.

In the illustrated embodiment, the air shaping passage 116 includes the flow control passage 14 disposed between the upstream chamber 16 (e.g., air shaping supply chamber) and the downstream chamber 18 (e.g., expansion chamber), which leads to one or more air shaping outlets 20 (e.g., 2, 3, 4, 5, 6, or more outlets) in a downstream portion of each protrusion 110. The flow control passage 14 may be disposed at an upstream region or base of the protrusions 110, such as in an upstream portion 126 of the spray cap 29. In certain embodiments, the flow control passage 14 may be disposed at least partially in or along a flow control structure 115 (e.g., an annular structural portion), which may be integral or separate from the spray cap 29. For example, the flow control structure 115 and the flow control passage 14 may be an integral part of (e.g., one-piece with or fixedly coupled to) the spray cap 29. By further example, the flow control structure 115 may be a flow control insert configured to couple with the spray cap 29, wherein the flow control passage 14 may be disposed at least partially within or along the flow control insert (e.g., completely within the insert, or between the insert and the spray cap 29.

The upstream chamber 16, the flow control passage 14, and the expansion chamber 18 may be substantially annular chambers or passages, which extend circumferentially 124 about the central axis 119. The flow control passage 14 may be sized smaller (e.g., reduced or restricted cross-sectional area and radial 122 width) relative to both the upstream chamber 16 and the expansion chamber 18. For example, the cross-sectional area or radial 122 width of the flow control passage 14 may be less than 5, 10, 15, 20, 25, 30, 35, 40, 45, 50, 55, or 60 percent of the corresponding cross-sectional area or radial 122 width of the upstream chamber 16 and/or the downstream chamber 18. By further example, the cross-sectional area or radial 122 width of the expansion chamber 18 may be equal to, less than, or greater than the corresponding cross-sectional area or radial 122 width of the upstream chamber 16. In certain embodiments, the cross-sectional area or radial 122 width of the expansion chamber 18 may be at least approximately 5, 10, 15, 20, 25, 30, 35, 40, 45, 50, 55, 60, 65, 70, 75, 80, 90, or 100 percent greater than the corresponding cross-sectional area or radial 122 width of the upstream chamber 16. Furthermore, the radial width 122 of the flow control passage 14, the upstream chamber 16, and the expansion chamber 18 may be uniform or varying in the circumferential direction 124 about the central axis 124, thereby providing a desired regulation and flow distribution of the air shaping flow to the air shaping outlets 20.

In operation, the flow control section 11 directs the air shaping flow to pass sequentially through the upstream chamber 16, the flow control passage 14, and the expansion chamber 18. In this manner, the flow control section 11 forces the air shaping flow to spread out for better distribution in the upstream chamber 16, squeeze through the reduced radial 122 width of the flow control passage 14 with a corresponding increase in velocity and reduction in static pressure for improved regulation and distribution of the air shaping flow, and then expand in the expansion chamber with a corresponding decrease in velocity and pressure recovery prior to delivery to the air shaping outlets 20. As a result, at each outlet 20 and between different outlets 20, the air shaping flow is more uniform (e.g., pressure, velocity, flow rate, etc.) as compared to a configuration without the flow control section 11. In certain embodiments, the flow control section 11 may reduce turbulence in the air shaping flow and/or provide a more laminar flow to the air shaping outlets 20. For example, air turbulence may be present in the air flow upstream of the flow control section 11 (e.g., due to fluctuations in the air supply 13; variations in the flow passages, such as bends, disruptions, intersections of passages, changes in geometry, etc.). However, the flow control section 11 (e.g., flow control passage 14 and chambers 16 and 18) may help to improve the air flow distribution (e.g., more uniform velocity, pressure, flow rate, etc.), which may help to reduce the turbulence generated upstream and/or provide a more laminar flow. In addition, the expansion chamber 18 may help to reduce noise created by the air flow upstream of the flow control section 11 and/or otherwise present in the spray tool 12 without the flow control section 11.

Figure 3:
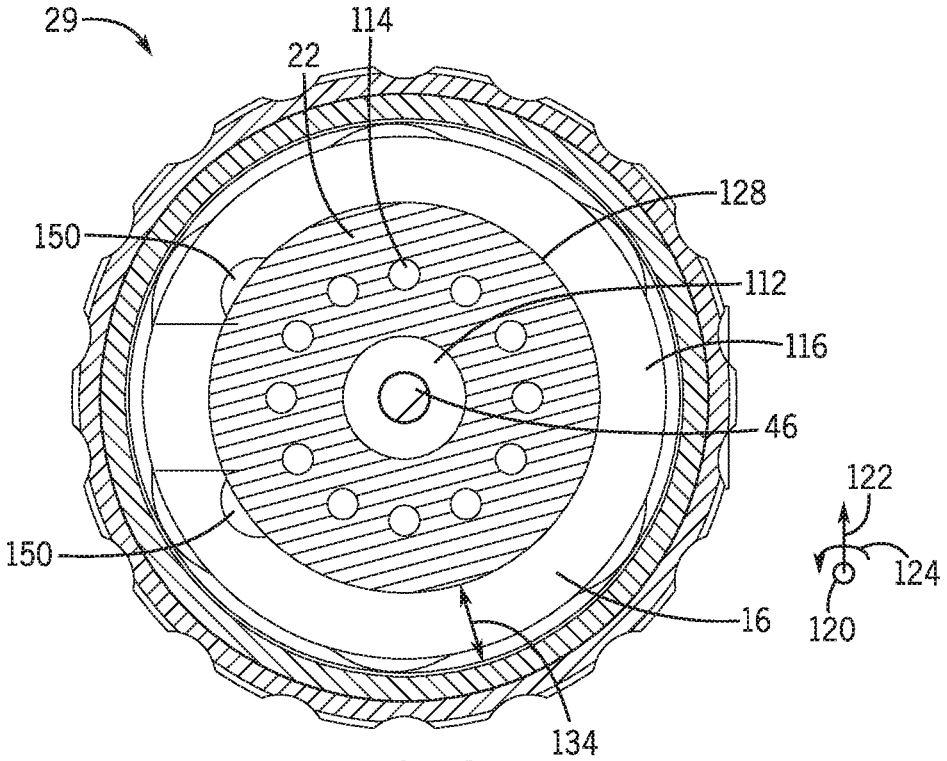
FIG. 3 is a cross-sectional front view of an embodiment of the spray cap of FIG. 2 taken along line 3-3, illustrating an upstream portion of the air shaping passage leading up to the flow control passage.
Figure 4:
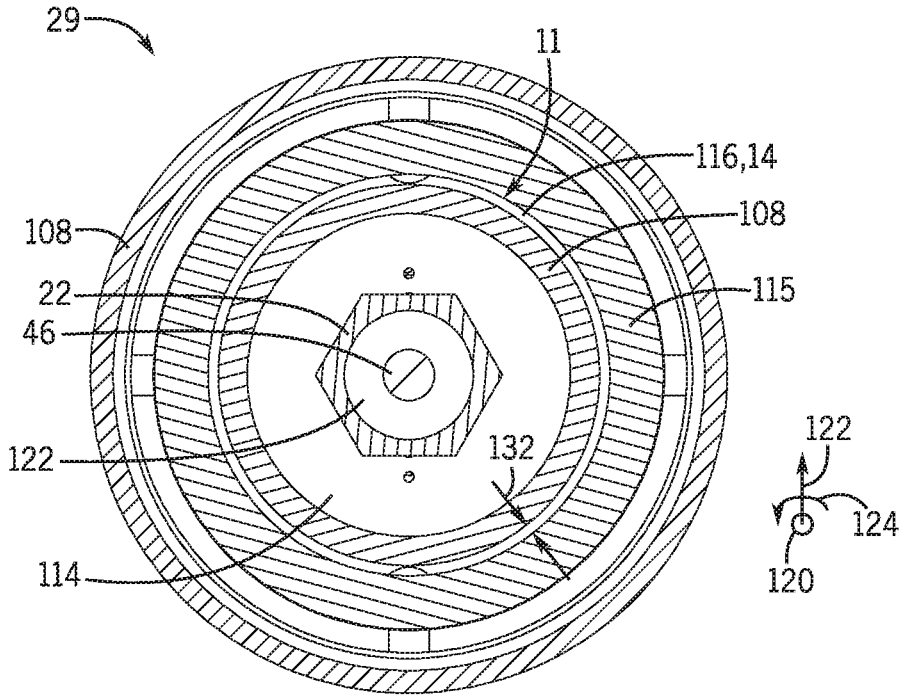
FIG. 4 is a cross-sectional front view of an embodiment of the spray cap of FIG. 2 taken along line 4-4, illustrating a portion of the air shaping passage at the flow control passage.
Figure 5:
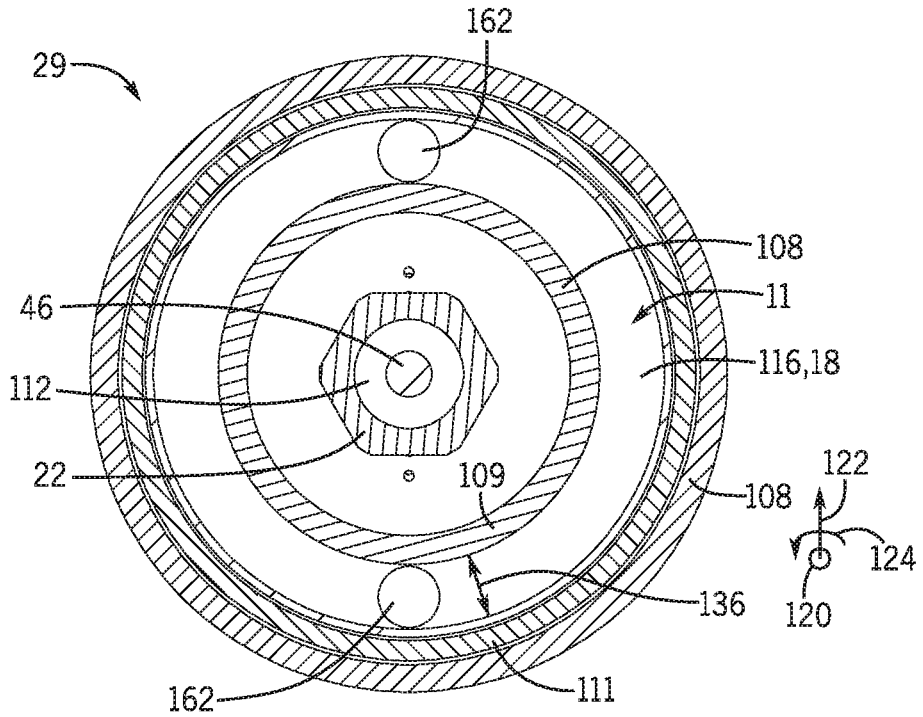
FIG. 5 is a cross-sectional front view of an embodiment of the spray cap of FIG. 2 taken along line 5-5, illustrating a downstream portion of the air shaping passage at the expansion chamber downstream from the flow control passage.

FIGS. 3, 4, and 5 are cross-sectional front views of the head portion 28 of FIG. 2, further illustrating details of the air shaping passage 116 as it changes in cross-sectional area and radial 122 width through the upstream chamber 16, the flow control passage 14, and the expansion chamber 18 in the spray cap 29. FIG. 3 is a cross-sectional front view taken along line 3-3 of FIG. 2, illustrating an upstream portion (e.g., the upstream chamber 16) of the air shaping passage 116 leading up to the flow control passage 14. The air shaping passage 116, specifically the upstream chamber 16, may be configured to receive the supplied air (e.g., from the air passage 68) via one or more discrete air holes 150 disposed in different discrete locations along the upstream chamber 16 (e.g., annular chamber). Given the discrete locations of the air holes 150, the air is supplied to the upstream chamber 16 (e.g., annular chamber) in a non-uniform matter. Again, further downstream, the flow control section 11, particularly the flow control passage 14 and the expansion chamber 18, is configured to help regulate and control distribution of the air flow to the air shaping outlets 20.

As illustrated in FIG. 3, the fluid passage 112 (e.g., annular fluid passage) is disposed circumferentially 124 about the needle valve 46 (e.g., coaxial arrangement). The fluid nozzle 22 (e.g., annular wall 128) is disposed circumferentially about the fluid passage 112 to help guide the fluid flow through the fluid passage 112 around the needle valve 46 to the fluid outlet 34. The fluid nozzle 22 also includes a portion of the air atomization passage 114, specifically a plurality of air atomization passages 114 disposed in a circumferential arrangement 130 in the annular wall 128 of the fluid nozzle 22. The air atomization passages 114 are configured to feed an airflow to the central bore 104 of the spray cap 29, and subsequently into the air atomization outlets 32. The upstream chamber 16 (e.g., annular chamber or flow passage) of the air shaping passage 116 is disposed circumferentially 124 around the fluid nozzle 22 and the upstream portion 126 of the spray cap 29. Thus, the fluid nozzle 22 and the upstream portion 126 of the spray cap 29 generally define an inner wall (e.g., inner annular wall) of the upstream chamber 16. The retaining assembly 30 (e.g., the retainer nut 125) is disposed circumferentially 124 around the upstream chamber 16, and thus defines an outer annular wall of the upstream chamber 16. Again, the upstream chamber 16 (e.g., annular chamber) helps to direct the air flow into the flow control passage 14 for improved flow distribution and regulation or control of the air flow (e.g., pressure, velocity, flow rate, etc.).

FIG. 4 is a cross-sectional front view taken along line 4-4 of FIG. 2, illustrating a portion of the air shaping passage 116 at the flow control passage 14. As illustrated, the flow control passage 14 has an annular cross-section (e.g., annular flow control passage), which has a radial width 132 that is less than a radial width 130 of the upstream chamber 16

(see FIG. 3). For example, the radial width 132 (or the cross-sectional area) of the flow control passage 14 may be less than 5, 10, 15, 20, 25, 30, 35, 40, 45, 50, 55, or 60 percent of the radial width 134 (or the cross-sectional area) of the upstream chamber 16. As a result, the flow control passage 14 restricts the air flow causing an increase in velocity and decrease in static pressure, thereby helping to regulate the air flow and better distribute the air flow into the downstream expansion chamber 18. In certain embodiments, the flow control passage 14 and the flow control structure 115 may be an integral part of (e.g., one-piece with or fixedly coupled to) the spray cap 29, or the flow control passage 14 may be disposed at least partially within or along a flow control insert (e.g., completely within the insert, or between the insert and the spray cap 29).

FIG. 5 is a cross-sectional front view taken along line 5-5 of FIG. 2, illustrating a downstream portion of the air shaping passage 116 at the expansion chamber 18 downstream from the flow control passage 14. As illustrated, the air shaping passage 116 expands from the flow control passage 14 into the expansion chamber 18, which is defined between two different portions (e.g., inner and outer walls 109 and 111) of the body 108 of the spray cap 29. The expansion chamber 18 has an annular cross-section (e.g., annular chamber or passage), which has a radial width 136 that is greater than the radial width 132 of the flow control passage 14 (see FIG. 4). For example, the radial width 136 (or the cross-sectional area) of the expansion chamber 18 may be at least approximately 5, 10, 15, 20, 25, 30, 35, 40, 45, 50, 55, 60, 65, 70, 75, 80, 90, or 100 percent greater than the radial width 132 (or the cross-sectional area) of the flow control passage 14. As a result, the expansion chamber 18 expands the air flow causing a decrease in velocity and pressure recovery, thereby further helping to regulate the air flow and better distribute the air flow into the downstream protrusions 110 and air shaping outlets 20. As the air flow exits the expansion chamber 18 and enters the protrusions 110, the spray cap 29 directs the air flow through a plurality of air horn passages or bores 162 of the air shaping passage 116. Each air horn or protrusion 110 includes at least one passage 162 of the air shaping passage 116, which in turn leads to the air shaping outlets 20.

Figure 6:
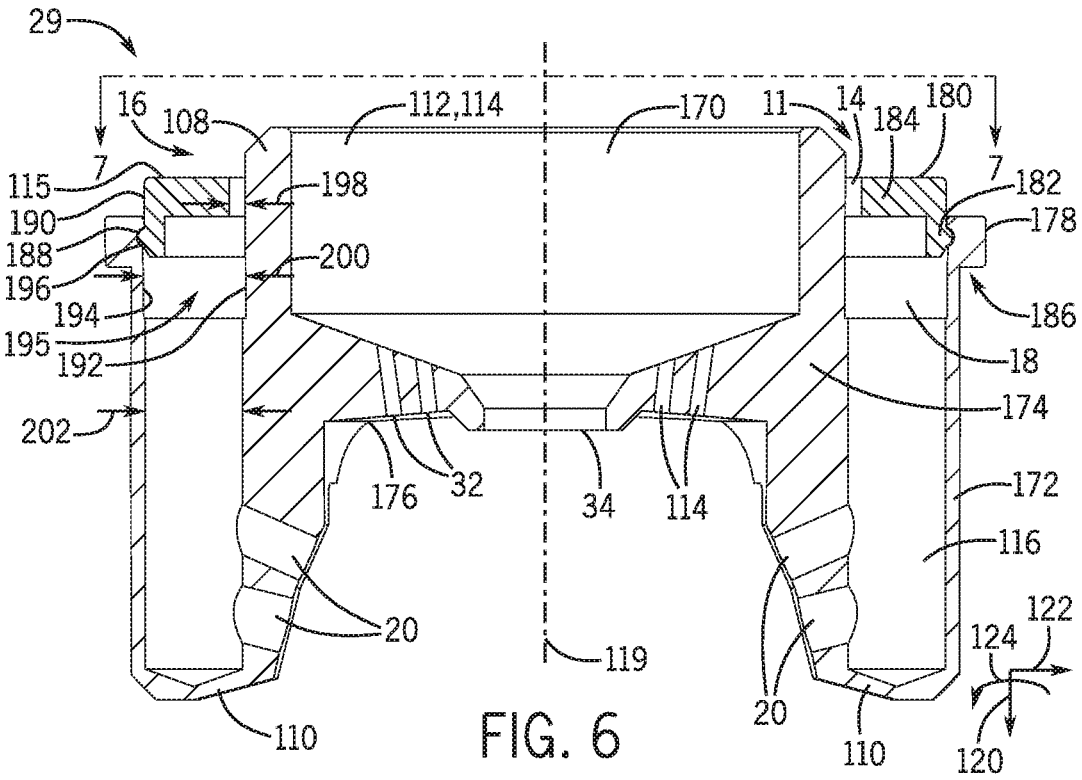
FIG. 6 is a cross-sectional side view of an embodiment of the spray cap of FIG. 1, illustrating a flow control insert disposed in a recess in a body of the spray cap, wherein the flow control passage is disposed partially along the flow control insert, and the expansion chamber is disposed between the flow control insert and the recess.

As mentioned above, the flow control passage 14 may be integrally formed with or separate from the body 108 of the spray cap 29. In FIGS. 6-10 below, embodiments of the air shaping passage 116 shown in FIG. 2 will be discussed in detail. FIG. 6 is a cross-sectional side view of an embodiment of the spray cap 29 of FIG. 1. As illustrated, the spray cap 29 includes the body 108 having an outer wall 172 (e.g., outer annular wall 111), an inner wall 174 (e.g., inner annular wall 109), and a central end wall 176. A fluid nozzle cavity 170 in the body 108 is configured to receive the fluid nozzle 22 that outputs a fluid through the fluid outlet 34 at the central end wall 176 for atomization into a spray. Circumferentially disposed about the fluid passage 112 within the fluid nozzle cavity 170 is the air atomization passage 114, which feeds the air flow through the spray cap 29 and out through the air atomization outlets 32 at the central end wall 176 to help atomize the fluid exiting the fluid outlet 34. Between the inner and outer walls 174 and 172, the air shaping passage 116 is circumferentially disposed about the air atomization passage 114. As discussed above, at least a portion of the air shaping passage 116 is a substantially annular passage (e.g., upstream chamber 16, flow control passage 14, and expansion chamber 18) extending circumferentially 124 about the central axis 119 of the spray cap 29, while a downstream portion of the air shaping passage 116 extends axially 120 through the protrusions 110 (e.g., passages 162 shown in FIG. 5). The air within the air shaping passage 116 flows through the protrusions 110 and exits the air shaping passage 116 (e.g., axial passages 162) at the one or more air shaping outlets 20 to shape the atomized fluid spray into a desired spray pattern (e.g., a flat spray). The body 108 of the spray cap 29 also includes a mounting flange 178 (e.g., along wall 111, 172), which is configured to couple the spray cap 29 to the head portion 28 of the spray tool 12 such that the spray cap 29 is removably secured via the retainer nut 125 (see FIG. 2) via threads, bolts and nuts, retaining ring, etc.

In the illustrated embodiment, the flow control passage 14 is disposed or created between a flow control insert 180 (e.g., a removable embodiment of the flow control structure 115) and the body 108 of the spray cap 29. The flow control insert 180 includes a first retainer portion 182 and a flow control portion 184. The first retainer portion 182 is configured to couple with a second retainer portion 186 of the body 108 of the spray cap 29, while the flow control portion 184 extends towards the inner wall 174 to form the flow control passage 14 (e.g., the flow control passage 14 is disposed between the flow control portion 184 and the inner wall 174). The first retainer portion 182 may include an annular protrusion 188 (e.g., outward radial protrusion) disposed on an outer surface 190 (e.g., outer annular surface) of the flow control insert 180. The second retainer portion 186 of the body 108 may include an inner recess surface 192 (e.g., inner annular recess) along the inner wall 174 and an outer recess surface 194 (e.g., outer annular recess) along the outer wall 172, thereby defining an annular recess or mounting region 195 configured to receive the flow control insert 180. In addition, an annular recess 196 is disposed on the outer recess surface 194 and is configured to receive the annular protrusion 188 of the flow control insert 180. Alternatively or additionally, the annular recess 196 may be disposed on the flow control inset 180 while the annular protrusion 188 is disposed on the body 108 of the spray cap 29. Alternatively or additionally, the annular recess 196 and the annular protrusion 188 may be disposed at the interface between the flow control insert 180 and the spray cap 29 at the inner wall 174. In some embodiments, the first retainer portion 182 of the flow control insert 180 and the second retainer portion 186 of the body 108 of the spray cap 29 may include snap-fit couplings, press-fit or interference-fit connections, or threaded connections (e.g., mating threads) to couple together the first and second retainer portions 182 and 186.

The expansion chamber 18 is disposed downstream of the flow control passage 14 and the flow control insert 180. In particular, the expansion chamber 18 is disposed between the flow control insert 180 and the annular recess 195 (e.g., the inner and outer recess surfaces 192 and 194) of the body 108. As such, the air shaping passage 116 has a varying radial width (or cross-sectional area) along the axial direction 120. In particular, the air shaping passage 116 has a radial width 132, 198 (or cross-sectional area) at the flow control passage 14, a radial width 136, 200 (or cross-sectional area) at the expansion chamber 18, and a radial width 202 (or cross-sectional area) through the protrusions 110. In general, the radial width 132, 198 (or cross-sectional area) is smaller than the radial width 136, 200 (or cross-sectional area). However, radial width 202 may be equal to or less than the radial width 136, 200, while the cross-sectional area 202 may be substantially less than the cross-sectional area 200 (e.g., due to the restriction of the air shaping passage 116 into axial passages 162 as shown in FIG. 5). Furthermore, the radial width 132, 198 (or cross-sectional area) of the flow control passage 14 may be equal to or less than approximately 5, 10, 15, 20, 25, 30, 35, 40, 45, 50, 55, or 60 percent of an upstream radial width adjacent an upstream side of the flow control passage 14 (e.g., radial width or cross-section 134 of the upstream chamber 16 shown in FIG. 3) and a downstream radial width of the expansion chamber 18 (e.g., radial width 136, 200).

Figure 7:
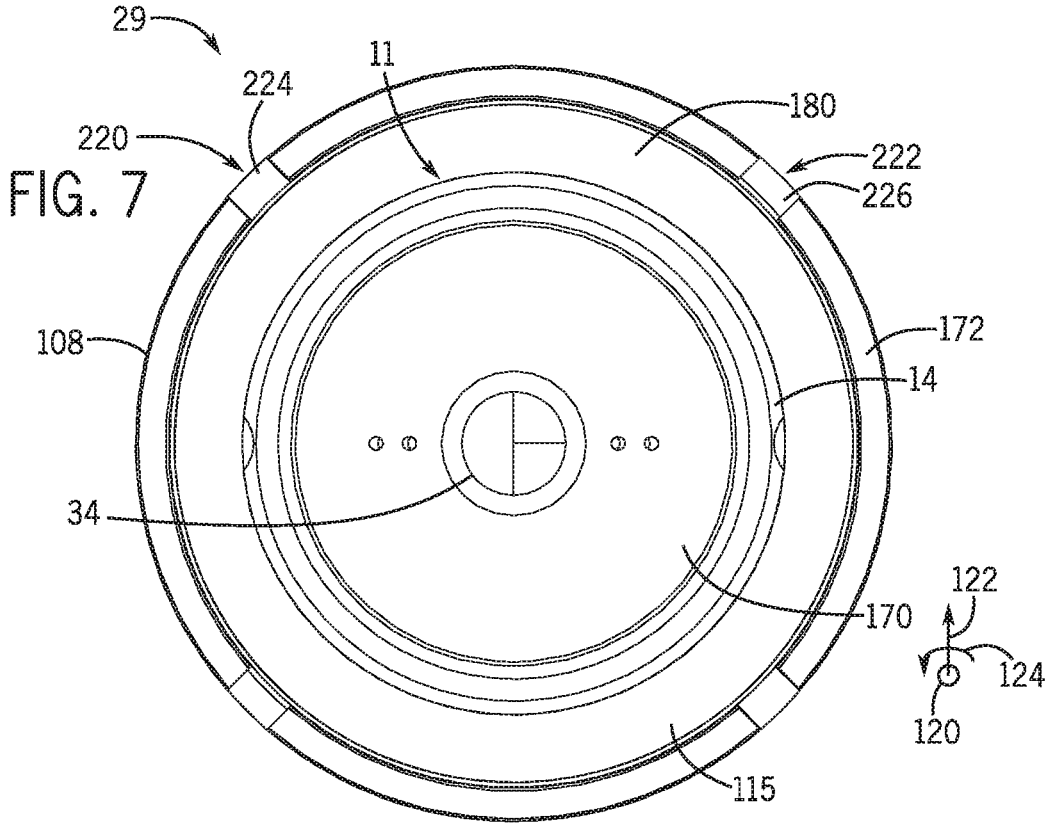
FIG. 7 is a top view of an embodiment of the spray cap of FIG. 6 taken along line 7-7, illustrating an annular shape of the flow control passage, and a plurality of alignment features that facilitate alignment between the flow control insert and the recess in the body of the spray cap.

FIG. 7 is a top view of an embodiment of the spray cap 29 of FIG. 6 taken along line 7-7. As illustrated, the flow control insert 180 may further include a first alignment feature 220 configured to interface with a second alignment feature 222 in the body 108 (e.g., the outer wall 172) as to ensure the correct alignment of the flow control insert 180 with the spray cap 29. Specifically, the first alignment feature 220 may include a plurality of alignment protrusions 224 (e.g., radial tabs, keys, or projections), the second alignment feature 222 may include a plurality of slots 226 (e.g., radial recesses, keyways, or grooves), and the plurality of alignment protrusions 224 are configured/sized to be received by the plurality of slots 226. In certain embodiments, the total number of the plurality of the protrusions 224 may be equal to or fewer than the total number of the plurality of slots 226. The flow control insert 180 may be made of any suitable material (e.g., plastic, metal, etc.) such that the flow control insert 180 may also provide substantial sealing (e.g., water-tight and air-tight) to seal the air shaping passage 116 from the ambiance/atmosphere. For example, the flow control insert 180 may be a cast metal (e.g., aluminum), an injection molded plastic (e.g., nylon, PEEK, polymer, etc.), an elastomeric material (e.g., rubber or other elastomer), a composite material (e.g., hard particles distributed in a matrix material), or any combination thereof.

Figure 8:
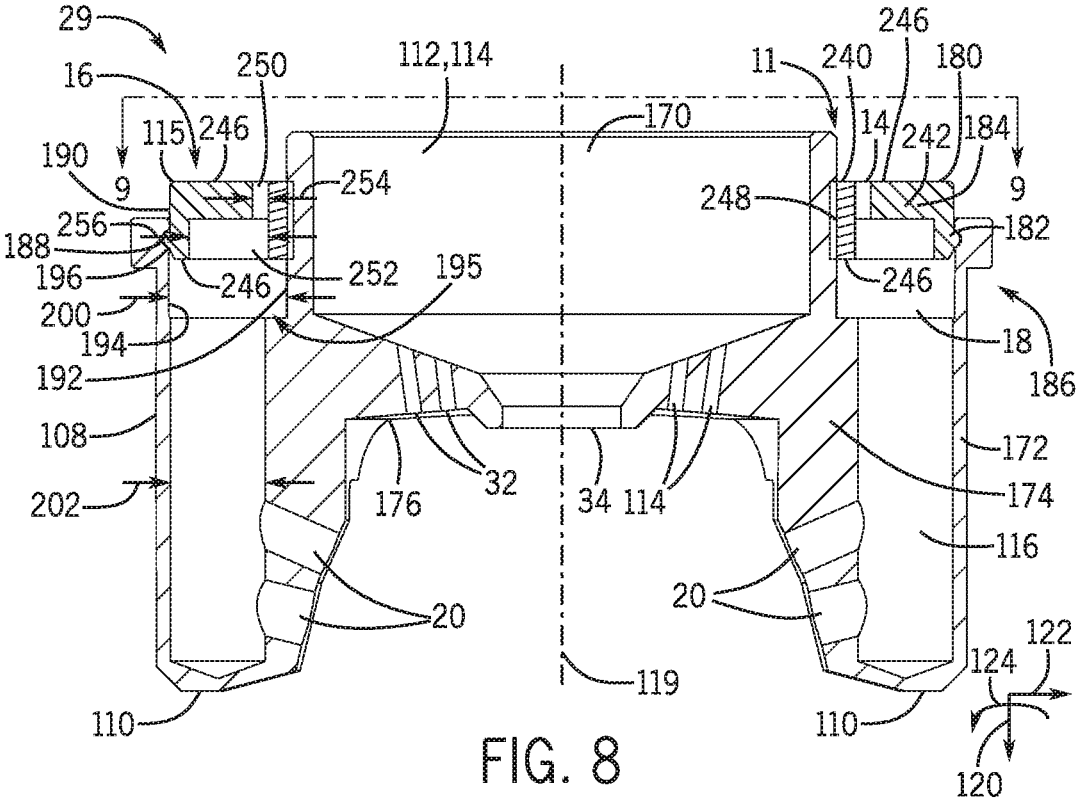
FIG. 8 is a cross-sectional side view of an embodiment of the spray cap of FIG. 1, illustrating a flow control insert disposed in a recess in a body of the spray cap, wherein the flow control insert includes inner and outer insert portions coupled together by one or more connecting portions, and the flow control passage is disposed between the inner and outer insert portions.

FIG. 8 is a cross-sectional side view of an embodiment of the spray cap 29 of FIG. 1, illustrating an embodiment of the air shaping passage 116 of FIG. 2, wherein the flow control passage 14 is disposed internally through the flow control insert 180. In the illustrated embodiment, the flow control insert 180 includes an inner insert portion 240 (e.g., inner annular insert portion) and an outer insert portion 242 (e.g., outer annular insert portion) coupled together by a structural support or connecting portion 244 (see FIG. 9) between axial end walls 246, wherein the flow control passage 14 is disposed between the inner and outer insert portions 240 and 242. Given that the inner and outer insert portions 240 and 242 are connected by the structural support 244 (e.g., circumferentially spaced radial arms, struts, linkages, or tabs), the flow control passage 14 may be described as a segmented annular flow control passage 14 and/or a substantially annular flow control passage 14 due to the insubstantial obstructions caused by the structural support 224. This segmented or substantially annular configuration of the flow control passage 14 is further illustrated and described with reference to FIG. 9.

The outer insert portion 242 includes the first retainer portion 182 and the flow control portion 184, which are configured to function in the same manner as discussed above in FIG. 6. For example, the first retainer portion 182 is configured to couple with the second retainer portion 186 of the body 108 of the spray cap 29 while the flow control portion 184 extends towards the inner insert portion 240 to form the flow control passage 14 (e.g., the flow control passage 14 is disposed between the flow control portion 184 and the inner insert portion 240). As set forth above, the first retainer portion 182 includes the annular protrusion 188 disposed on the outer surface 190 of the flow control insert 180. The second retainer portion 186 of the body 108 includes the inner recess surface 192 along the inner wall 174 and the outer recess surface 194 along the outer wall 172. The annular recess 196 is disposed on the outer recess surface 194 and is configured to receive the annular protrusion 188 of the flow control insert 180.

The inner insert portion 240 has an inner insert wall or surface 248 that is configured to contact the inner recess surface 192 along the inner wall 174. These surfaces 192 and 248 may be configured to couple together with an interference-fit or press-fit connection, a threaded interface (e.g., mating threads), or any combination thereof. In some embodiments, the inner recess surface 192 may include an annular recess or slot sized to receive the inner insert portion 240 along the inner insert wall 248 between the axial end walls 246. In some embodiments, the first retainer portion 182 of the flow control insert 180 and the second retainer portion 186 of the body 108 of the spray cap 29 may include any retaining features to snap-fit, press-fit or interference-fit, or thread together the first and second retainer portions 182 and 186. It may also be appreciated that each of the inner and outer insert portions 240 and 242 of the flow control insert 180 may include any appropriate retaining features to snap-fit, press-fit, interference-fit, or thread together with the second retainer portions 186 along the inner and outer recess surfaces 192 and 194, respectively.

As set forth above, the expansion chamber 18 is disposed between the flow control insert 180 and the annular recess 195 (e.g., the inner and outer recess surfaces 192 and 194) of the body 108. The air shaping passage 116 has a varying radial width along the axial direction 120. As illustrated, the flow control passage 14 includes a first passage 250 and a second passage 252 disposed one after another through the flow control insert 180. The first passage 250 is between the flow control portion 184 of the outer insert portion 242 and the inner insert portion 240, and has a radial width (or cross-sectional area) 254. The second passage 252 is between the first retainer portion 182 of the outer insert portion 242 and the inner insert portion 240, and has a radial width (or cross-sectional area) 256. As may be appreciated, the radial width (or cross-sectional area) 254 is smaller than the radial width 256, which is smaller than the radial width (or cross-sectional area) 200 at the expansion chamber 18. Furthermore, the radial width (or cross-sectional area) 254 of the first passage 250 of the flow control passage 14 may be equal to or less than approximately 5, 10, 15, 20, 25, 30, 35, 40, 45, 50, 55, or 60 percent of an upstream radial width adjacent an upstream side of the flow control passage 14 (e.g., radial width or cross-section 134 of the upstream chamber 16 shown in FIG. 3) and a downstream radial width of the expansion chamber 18 (e.g., radial width 136, 200).

Figure 9:
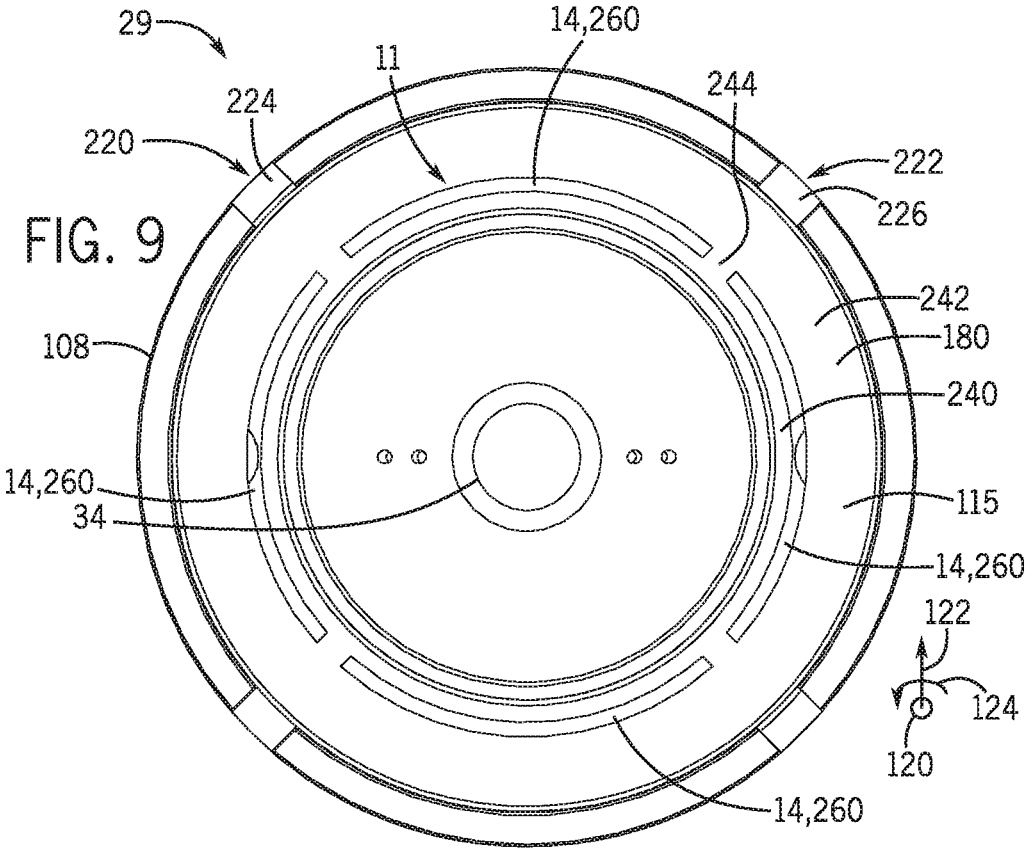
FIG. 9 is a top view of an embodiment of the spray cap of FIG. 8 taken along line 9-9, illustrating a substantially annular shape (e.g., segmented annular shape) of the flow control passage between the inner and outer insert portions, and the one or more connecting portions coupling the inner and outer insert portions.

FIG. 9 is a top view of an embodiment of the spray cap 29 of FIG. 8 taken along line 9-9. As illustrated, the flow control insert 180 includes the alignment features 220, 222, 224, and 226 to ensure the correct alignment of the flow control insert 180 with the spray cap 29 as discussed in detail above with reference to FIG. 7. In addition, FIG. 9 further illustrates the construction of the inner insert portion 240 and the outer insert portion 242 coupled together by the structural support 244. Since an insubstantial portion of the flow control passage 14 is blocked by the structural support 244 (e.g., non-continuous and discrete), the flow control passage 14 may be described as a substantially annular or segmented annular flow control passage 14. For example, the flow control passage 14 (e.g., first and/or second passage 250 and 252) includes a plurality of passage portions 260 (e.g., first, second, third and fourth passage portions) circumferentially 124 spaced about the central axis 119 of the spray cap 29, thereby defining a segmented or substantially annular passage. In certain embodiments, the spray cap 29 may include 1, 2, 3, 4, 5, 6, 7, 8, 9, 10, or more structural supports 244, and thus may include 2, 3, 4, 5, 6, 7, 9, 9, 10, 11, or more passage portions 260. The total cross-sectional area of the structural support 244 may be relatively small (e.g., less than 5, 10, 15, or 20 percent) compared to the total cross-sectional area of the plurality of passage portions 260. For example, the flow control passage 14 may be at least 80, 85, 90, or 95 continuous to define a substantially annular flow control passage. Also, despite the flow control passage 14 being composed of the plurality of passage portions 260, the flow control insert 180 may still provide substantial sealing (e.g., water-tight and air-tight) to seal the air shaping passage 116 from the other flow passages and the external environment. In some embodiments, the flow control insert 180 may include the inner and outer insert portions 240 and 242 without any intermediate structural support 244, wherein each of the insert portions 240 and 242 is coupled to the body 108 of the spray cap 29 via a press-fit or interference fit, a threaded interface, a snap-fit or latch coupling, a retainer ring, or any combination thereof. In such embodiments, the flow control passage 14 may be a continuous annular passage rather than a segmented annular passage.

Figure 10:
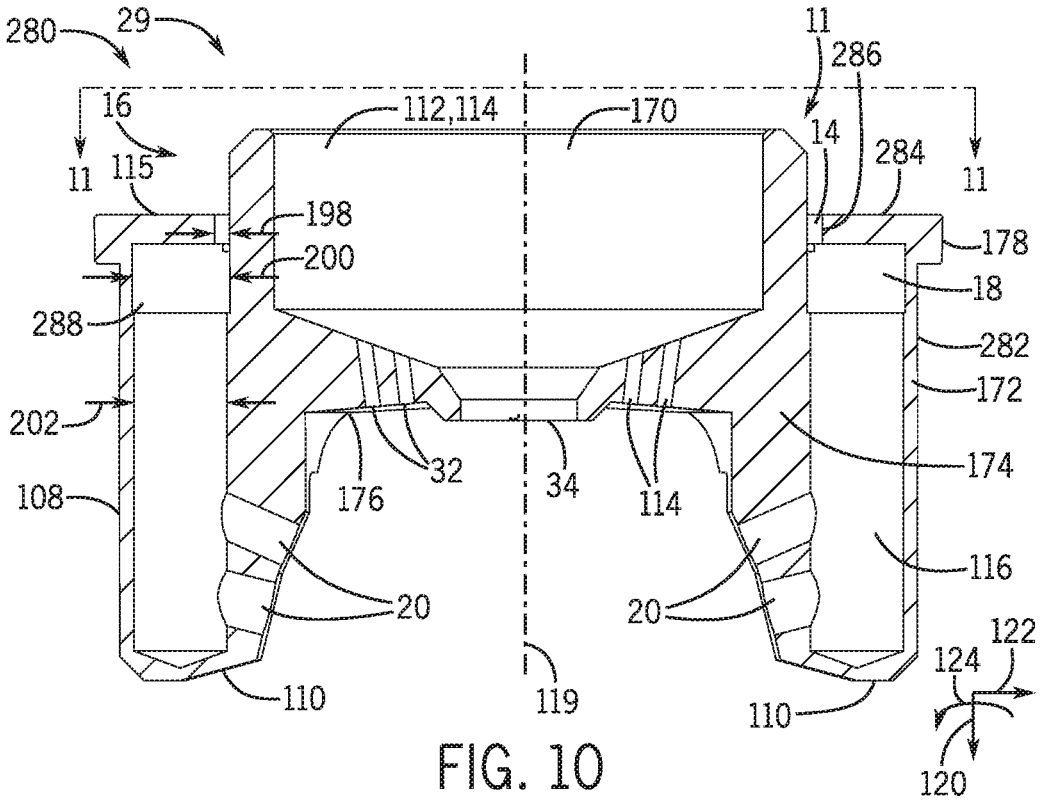
FIG. 10 is a cross-sectional side view of an embodiment of the spray cap of FIG. 1, illustrating a one-piece construction of the air cap (e.g., one-piece structure) having an air shaping passage with a flow control passage, an expansion chamber, and one or more air shaping outlets.

FIG. 10 is a cross-sectional side view of an embodiment of the spray cap 29 of FIG. 1, wherein the spray cap 29 is a one-piece structure 280 having the air shaping passage 116 with the flow control passage 14 and the expansion chamber 18. In general, the one-piece structure 280 described herein may have the body 108 that conforms with any of the structural features/shapes of the spray cap 29 discussed above in FIGS. 6-9 (e.g., the flow control insert 180 is integrally formed as part of the one-piece structure 280). For example, the one-piece structure 280 has the body 108, including the outer wall 172 and the inner wall 172, which generally define the air shaping passage 116. In particular, the outer wall 172 extends around a passage portion 282 of the air shaping passage 116. The outer wall 172 also includes the mounting flange 178 configured to couple with the retainer nut 125. The spray cap 29 also includes a flow control portion 284, similar to the flow control structure 115 and the flow control insert 180, which defines the flow control passage 14. The passage portion 282 extends from the mounting flange 178 along the protrusions 110 in the axial 120 direction, while the flow control portion 284 extends from the mounting flange 178 in the radial direction 122 towards the inner wall 174. The flow control portion 284 ends at an inner annular surface 286, such that the flow control passage 14 is disposed between the inner wall 174 and the inner annular surface 286 and is annular with respect the central axis 119 of the spray cap 29.

Figure 11:
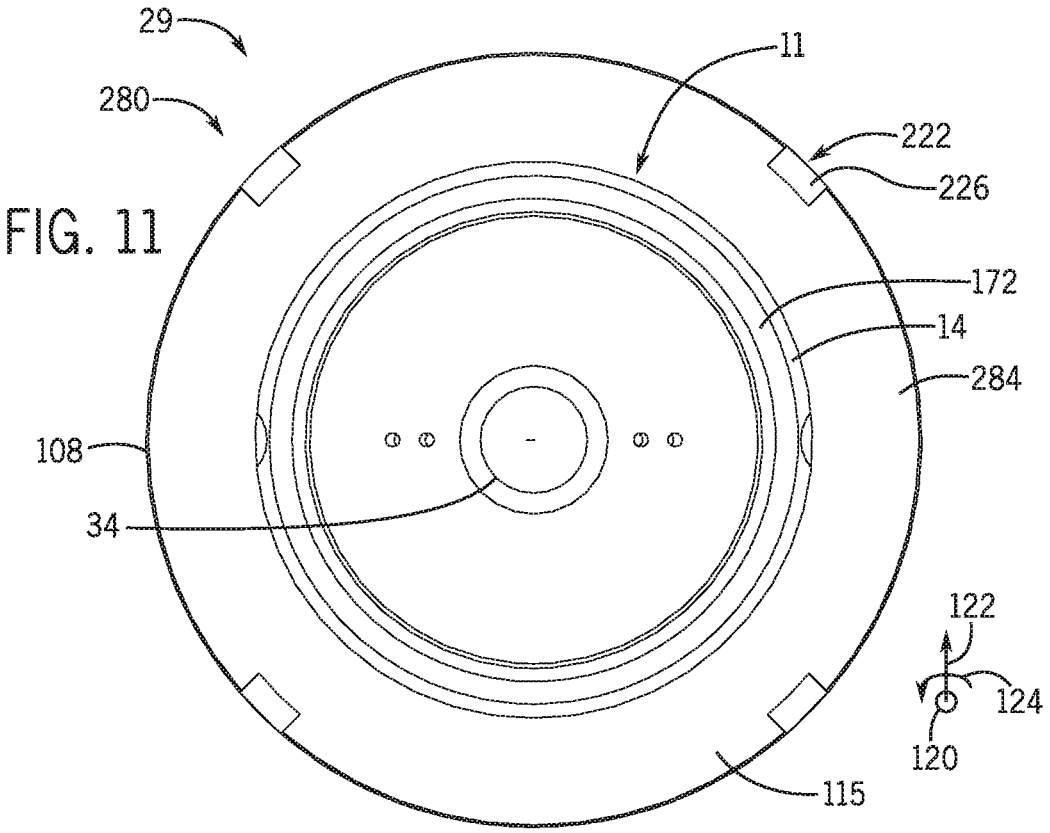
FIG. 11 is a top view of an embodiment of the spray cap of FIG. 10 taken along line 11-11.

Furthermore, the one-piece structure 280 also includes an annular recess or cavity 288 downstream of the flow control passage 14, thereby defining the expansion chamber 18 (e.g., annular expansion chamber). Accordingly, the air shaping passage 116 of the one-piece structure 280 has the radial width 198 at the flow control passage 14, the radial width 200 at the expansion chamber 18, and the radial width 202 through the horns 100. The radial widths (or cross-sectional areas) 132, 134, 136, 198, 200, and 202 are generally the same as described in detail above. A top view of an embodiment of the spray cap 29 of FIG. 10 taken along line 10-10 is shown in FIG. 11. As illustrated, the spray cap 29 includes the one-piece structure 280 with the flow control passage 14 disposed between the inner wall 174 and the flow control portion 284 of the outer wall 172.

It may be appreciated that the spray 29 composed of the one-piece structure 280 can be built using an additive manufacturing technique such as a direct metal laser sinter (DMLS) process, wherein the spray cap 29 may include any suitable laser sintered metal material (e.g., stainless steel, nickel-chromium alloy, aluminum alloy, etc.). The structural features discussed above may be built in a layer-by-layer fashion. The one-piece structure 280 may also be built using any other additive manufacturing techniques, such as 3D-printing, wherein the spray cap 29 may include any suitable plastic or metal materials for the additive manufacturing technique. Regardless of the manufacturing technique at choice, the built spray cap 29 may provide substantial sealing (e.g., water-tight and air-tight) to seal the air shaping passage 116 from the other flow passages and the external environment.

Figure 12:
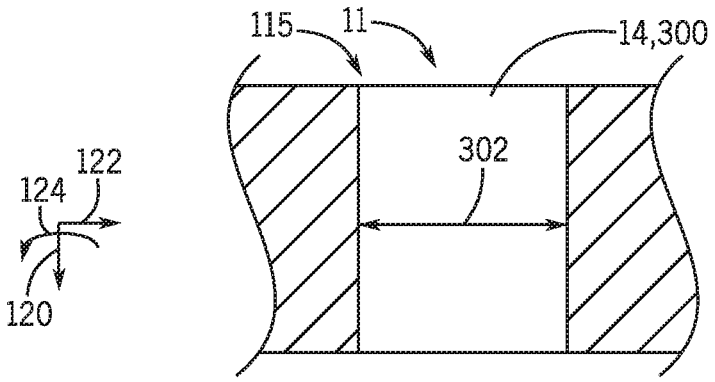
FIG. 12 is a partial cross-sectional side view of an embodiment of the flow control passage of FIG. 2, wherein the flow control passage has a constant-width passage with a radial width that is constant in an axial direction along a central axis of the spray cap.
Figure 13:
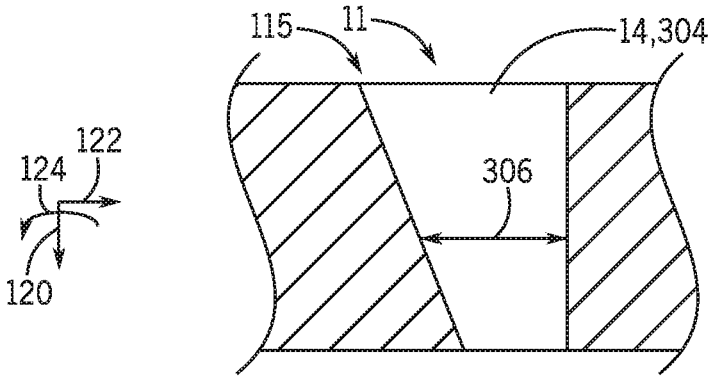
FIG. 13 is a partial cross-sectional side view of an embodiment of the flow control passage of FIG. 2, wherein the flow control passage has a converging-width passage with a radial width that increases or decreases in an axial direction along a central axis of the spray cap.
Figure 14:
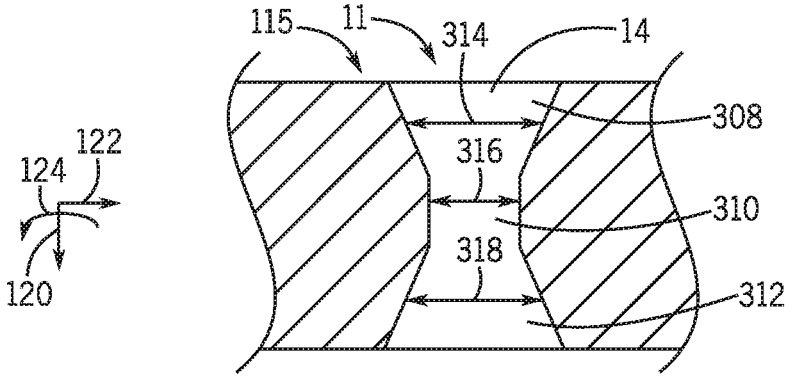
FIG. 14 is a partial cross-sectional side view of an embodiment of the flow control passage of FIG. 2, wherein the flow control passage has a converging passage portion, a throat portion, and a diverging passage portion, such that the radial width of the flow control passage decreases and then increases in an axial direction along a central axis of the spray cap.

In addition, while the flow control passage 14 discussed above in FIGS. 1-11 may have a radial width (or cross-sectional area) 132, 198, 254 that is constant in the axial direction 120 along the central axis 119 of the spray cap 29, some embodiments of the flow control passage 14 may have a radial width (or cross-sectional area) 132, 198, 254 that varies (e.g., increases and/or decreases) in the axial direction 120 along the central axis 119 of the spray cap 29 as shown in FIGS. 12-14. FIGS. 12 to 14 each shows a cross-sectional side view of an embodiment of the flow control passage 14 of FIGS. 1-11. As illustrated in FIG. 12, the flow control passage 14 is a constant width passage 300 having a radial width (or cross-sectional area) 132, 198, 254, 302 that is constant along the axial direction 120. In FIG. 13, the flow control passage 14 is a converging passage 304 having a radial width (or cross-sectional area) 132, 198, 254, 306 that decreases along the axial direction 120. In FIG. 14, the flow control passage 14 includes a venture-type configuration with a series of a converging passage portion 308, a throat portion 310, and a diverging passage portion 312 disposed one after another. The converging passage portion 308 has a radial width (or cross-sectional area) 314 that decreases along the axial direction 120, the throat portion 310 has a radial width (or cross-sectional area) 316 that is constant along the axial direction 120, and the diverging passage portion 312 has a radial width (or cross-sectional area) 318 that increases along the axial direction 120. Again, in each of the illustrated embodiments of FIGS. 12-14, the flow control passage 14 may be a continuous annular passage or a substantially annular or segmented annular passage as described in detail above. Furthermore, it may be appreciated that transitions between adjacent portions (e.g., 308/310 and 310/312) may be rather smooth, e.g., curved transitions.

Furthermore, while the flow control passage 14 discussed above in FIGS. 12-14 may have the radial width (or cross-sectional area) 132, 198, 254 that is constant or varies (e.g., increases and/or decreases) in the axial direction 120 along the central axis 119 of the spray cap 29, some embodiments of the flow control passage 14 may also have the radial width 132, 198, 254 that is constant or varies in a circumferential direction 124 about the central axis 119 of the spray cap 29 as shown in FIGS. 15-16. FIG. 15 is a cross-sectional front view of an embodiment of the spray cap 29 of FIG. 2 taken along line 4-4, illustrating another embodiment the flow control passage 14. As illustrated, the radial width (or cross-sectional area) 132, 198, 254 of the flow control passage 14 varies (e.g., increases) in the circumferential direction 124 toward the air horn passages 162, such that the radial width (or cross-sectional area) 132, 198, 254 is the largest around or adjacent the air horn passages 162 and the smallest between the air horn passages 162 (e.g., approximately midway between or 90 degrees relative to the air horn passages 162). Contrarily, in another embodiment, the radial width (or cross-sectional area) 132, 198, 254 of the flow control passage 14 in FIG. 16 varies (e.g., decreases) in the circumferential direction 124 toward the air horn passage 162, such that the radial width (or cross-sectional area) 132, 198, 254 is the smallest around or adjacent the air horn passages 162 and the largest between the air horn passages 162 (e.g., approximately midway between or 90 degrees relative to the air horn passages 162). In each of the illustrated embodiments of FIGS. 15-16, the flow control passage 14 may be a continuous annular passage or a substantially annular or segmented annular passage as described in detail above. Furthermore, the radial width or cross-sectional area (e.g., 132, 198, 254) may gradually change or vary in a substantially smooth manner, e.g., curved transitions.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a nozzle, wherein the nozzle is segregated from a spray cap by an interface, wherein the spray cap is configured to couple to a spray tool, wherein the spray cap comprises:

a one-piece spray cap body;

a flow control insert body disposed within the one-piece spray cap body, wherein the flow control insert body is a single piece comprising an inner insert portion and an outer insert portion;

a flow control passage formed within and extending through the flow control insert body, wherein the flow control passage is defined by a first surface of the inner insert portion and a second surface of the outer insert portion, the flow control passage comprises a first passage and a second passage downstream from the first passage, the first passage comprises a first radial width, the second passage comprises a second radial width, and the second radial width is greater than the first radial width;

an expansion chamber extending through the one-piece spray cap body, wherein the expansion chamber is downstream from the flow control passage and the expansion chamber comprises a constant third radial width greater than the second radial width; and one or more air shaping outlets formed in the one-piece spray cap body, wherein the one or more air shaping outlets are downstream from the expansion chamber.

2. The system of claim 1, wherein the flow control insert body is disposed in a recess in the one-piece spray cap body, and the expansion chamber is disposed downstream of the flow control insert body.

3. The system of claim 1, wherein the flow control insert body comprises a first retainer portion configured to couple with a second retainer portion of the one-piece spray cap body, wherein the first retainer portion comprises a protrusion, and the second retainer portion comprises a recess.

4. The system of claim 3, wherein the first and second retainer portions are configured to snap-fit together, and wherein the protrusion is an annular protrusion.

5. The system of claim 2, wherein the flow control insert body is press-fit or interference fit into the recess in the one-piece spray cap body.

6. The system of claim 2, wherein the flow control insert body is threaded into the recess in the one-piece spray cap body.

7. The system of claim 1, wherein the flow control insert body comprises a first alignment feature configured to interface with a second alignment feature in the one-piece spray cap body.

8. The system of claim 1, wherein the first radial width of the first passage is equal to or less than approximately 50 percent of an upstream radial width of an upstream chamber of the spray tool adjacent an upstream side of the flow control insert body and the constant third radial width of the expansion chamber adjacent a downstream side of the flow control insert body.

9. The system of claim 1, wherein the first radial width of the first passage is equal to or less than approximately 25 percent of an upstream radial width of an upstream chamber of the spray tool adjacent an upstream side of the flow control insert body and the constant third radial width of the expansion chamber adjacent a downstream side of the flow control insert body.

10. The system of claim 1, wherein the flow control passage is a substantially annular passage extending circumferentially about a central axis of the spray cap.

11. The system of claim 1, wherein the first radial width and the second radial width are each constant in an axial direction along a central axis of the spray cap.

12. The system of claim 1, comprising a fluid nozzle cavity in the one-piece spray cap body, wherein the fluid nozzle cavity is configured to receive the nozzle, wherein the nozzle outputs a fluid that is atomized into a spray.

13. A system, comprising:

a flow control insert disposed within a one-piece body of a spray cap of a spray tool, wherein the flow control insert is a single piece having a first axial end and a second axial end opposite the first axial end and comprises an inner insert portion, an outer insert portion, and a flow control passage extending internally through the flow control insert, wherein a first surface of the inner insert portion and a second surface of the outer insert portion define the flow control passage, wherein the flow control passage comprises a first passage and a second passage downstream from the first passage, wherein the first passage comprises a first radial width, the second passage comprises a second radial width, and the second radial width is greater than the first radial width, and wherein the flow control passage extends internally from an upstream axial wall of the first axial end to a downstream axial wall of the second axial end; and a fluid nozzle disposed in the fluid nozzle receptacle, wherein the fluid nozzle is segregated from the spray cap by an interface.

14. The system of claim 1, wherein the flow control passage extends through the flow control insert body from an upstream axial end wall of the flow control insert body to a downstream axial end wall of the flow control insert body.

15. The system of claim 1, wherein the first passage and the second passage of the flow control passage are both partially defined by a continuous common wall.

16. The system of claim 1, comprising a retainer nut configured to couple the one-piece spray cap body to the spray tool.

17. The system of claim 3, wherein the first retainer portion radially overlaps with the second passage.

18. The system of claim 1, comprising the spray tool having the spray cap.

19. A system, comprising:

a spray tool, comprising:

a body portion having a fluid passage and an air passage; and a head portion fluidly coupled to the fluid passage and the air passage, wherein the head portion comprises:

a one-piece spray cap body comprising a fluid nozzle receptacle, an air atomization passage;

a flow control insert body disposed within the one-piece spray cap body, wherein the flow control insert body is a single piece comprising an inner insert portion and an outer insert portion; and an air shaping passage, wherein the air shaping passage comprises a flow control passage, an expansion chamber extending through the one-piece spray cap body and disposed downstream from the flow control passage, and one or more air shaping outlets formed in an air horn of the one-piece spray cap body and disposed downstream from the expansion chamber, wherein the flow control passage extends through the flow control insert body, wherein the flow control passage comprises a first passage and a second passage downstream from the first passage, wherein the first passage, the second passage, the expansion chamber, and the one or more air shaping outlets are fluidly connected in series, and wherein the first passage comprises a first radial width, the second passage comprises a second radial width, and the second radial width is greater than the first radial width; and a fluid nozzle disposed in the fluid nozzle receptacle, wherein the fluid nozzle is segregated from the spray cap by an interface.

* * * * *